US006283209B1

(12) United States Patent
Keller

(10) Patent No.: US 6,283,209 B1
(45) Date of Patent: Sep. 4, 2001

(54) FLEXIBLE LINER SYSTEM FOR BOREHOLE INSTRUMENTATION AND SAMPLING

(76) Inventor: Carl E. Keller, P.O. Box 9827, Santa Fe, NM (US) 87544

( * ) Notice: Subject to any disclaimer, the term of this patent is extended or adjusted under 35 U.S.C. 154(b) by 0 days.

(21) Appl. No.: 09/503,057

(22) Filed: Feb. 12, 2000

Related U.S. Application Data

(60) Provisional application No. 60/120,270, filed on Feb. 16, 1999.

(51) Int. Cl.[7] ..... E21B 47/00; E21D 11/00

(52) U.S. Cl. ..... 166/264; 166/242.2; 405/146

(58) Field of Search ..... 166/264, 250.01, 166/242.1, 242.2, 387; 405/146, 154, 147

(56) References Cited

U.S. PATENT DOCUMENTS

| | | | | |
|---|---|---|---|---|
| 2,927,775 | * | 3/1960 | Hilderbrandt | 255/72 |
| 3,580,334 | * | 5/1971 | Broussard et al. | 166/250 |
| 4,064,211 | | 12/1977 | Wood | 264/95 |
| 5,176,207 | | 1/1993 | Keller | 166/64 |
| 5,725,055 | | 3/1998 | Schirmer et al. | 166/264 |
| 5,794,702 | * | 8/1998 | Nobileau | 166/380 |
| 5,853,049 | * | 12/1998 | Keller | 166/380 |
| 6,026,900 | * | 2/2000 | Keller | 166/250.01 |
| 6,116,353 | * | 9/2000 | Leavell et al. | 175/22 |

* cited by examiner

*Primary Examiner*—Frank S. Tsay

(57) ABSTRACT

A flexible liner system provides for instrumentation and sampling within a cavity. An elongated flexible liner effectively contacts wall portions of the cavity when inflated within the cavity and has a top and a bottom and has perforations open to the cavity wall portions at selected locations along the liner. At least one sleeve is sealed to the flexible liner and extends from the top portion of the liner to a perforation at one of the selected locations along the liner to define a sealed interior open to a cavity wall portion. A well casing may be place within the sleeve for fluid sampling or for emplacing instrumentation adjacent the perforations in the flexible liner.

10 Claims, 7 Drawing Sheets

Section A-A'

FLEXIBLE LINER SYSTEM FOR BOREHOLE INSTRUMENTATION AND SAMPLING

RELATED APPLICATIONS

This application claims the benefit of U.S. Provisional Application 60/120,270, filed Feb. 16, 1999.

FIELD OF THE INVENTION

This invention relates to borehole liners, and, more particularly, to the use of long flexible liners to emplace instruments and sampling devices in boreholes and the like.

BACKGROUND OF THE INVENTION

In drilling boreholes for emplacement of measurement or sampling devices, the common practice is to install the desired device in the borehole and then to seal the entire hole with a sealing material. U.S. Pat. No. 5,176,207, issued Jan. 5, 1993, to Keller, teaches the use of a flexible tubular member to both seal and support a borehole and to carry instruments into a borehole as the flexible member is everted into the borehole. Instrumentation and sampling devices can then be placed directly in contact with the surrounding structure. These everting liners may be installed from the interior of a pressure canister into the hole or otherwise everted into a borehole or other cavity.

An alternative to drilling single wells to obtain water samples at several elevations in an aquifer is to install several wells of different depths in one deep hole (called nested wells). However, the sealing of a bundle of well casings is difficult. Hence vertical flow in the interstitial spaces in the nested well bundle can prevent the isolation required for the several wells. This problem of a vertical seal of several wells in one hole is especially evident when installing several wells in a very slender, economical borehole.

The present invention allows the emplacement of several wells in a borehole that is sealed, not by a fill material poured around the wells, but rather, with a pressurized flexible liner surrounding the wells. System components are available as needed for repair or replacement. The hole remains open and available for other purposes.

When flexible liners are everted into boreholes, and the like, any instrumentation and sampling tubing attached to the liner must evert with the liner. The instrumentation and tubing will then have to conform to the radius of curvature of the liner at the bottom end of the everting liner. In a small diameter borehole, this radius of curvature will be quite small and can limit the use of such instrumentation and sampling tubing. Accordingly, it is an object of this invention to permit the use of everting liners for sampling and instrumentation in small diameter boreholes.

Various objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, a flexible liner system provides for instrumentation and sampling within a cavity. An elongated flexible liner effectively contacts wall portions of the cavity when inflated within the cavity and has a top and a bottom and has perforations open to the cavity wall portions at selected locations along the liner. At least one sleeve is sealed to the flexible liner and extends from the top portion of the liner to a perforation at one of the selected locations along the liner to define a sealed interior open to a cavity wall portion. A well casing may be place within the sleeve for fluid sampling or for emplacing instrumentation adjacent the perforations in the flexible liner.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIG. 5 is a side cross-section showing inversion removal (or deflation) of the liner from a borehole, or the like.

DETAILED DESCRIPTION

In accordance with the present invention, a pressurized flexible liner is everted within a borehole, or other cavity such as a pipe, to seal the cavity. Sleeves are located on either the external or internal surface of the liner so as to allow, e.g., a well screen and casing or instrumentation device to be emplaced in each sleeve. The sleeve isolates the well casing from the fluid in the liner and allows the well to draw water (or other pore fluids) from the formation surrounding the bore hole. Likewise, instrumentation can be placed and removed from selected locations along the cavity while maintaining support of and contact with the cavity wall. The result is a set of nested wells at relatively low cost with exceptionally good isolation of each well screen from the others.

Figure 1A:
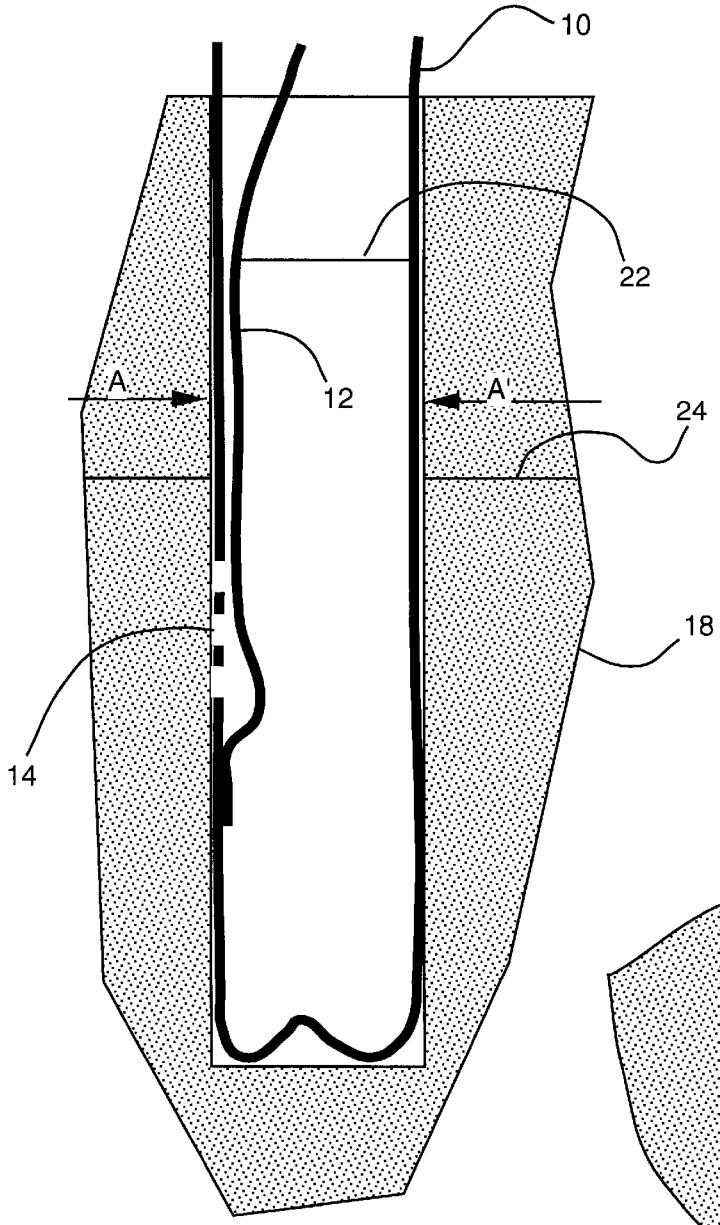
FIGS. 1A and 1B are side and top cross-section views, respectively of a flexible liner with an interior sleeve according to one embodiment of the present invention.
Figure 1B:
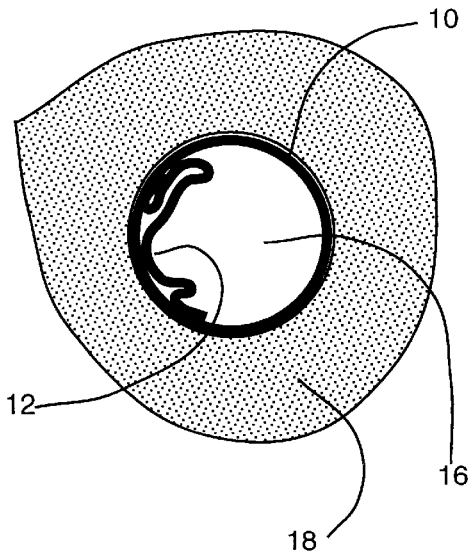

The installation of a flexible liner into a borehole or pipe can be done in many ways. Examples of such installations are: U.S. Pat. No. 4,064,211 by Wood; U.S. Pat. No. 5,176,207 by Keller; U.S. patent application Ser. No. 09/484,299, filed Jan. 18, 2000, by Keller; or by simply lowering the liner into the hole. The emplaced liner has the features shown in FIGS. 1A and 1B. The impermeable liner 10 has an open upper end and a closed lower end. The lower end may be attached to a tube or cord (not shown) for retrieval of the liner by inversion. In accordance with the present invention, impermeable sleeve 12 is attached to a surface of liner 10. As shown in FIGS. 1A and 1B, sleeve 12 is preferably attached to the interior surface of liner 10, but sleeve 12 could be attached to the exterior surface (surface that faces the cavity) of liner 10. In a preferred design, liner 10 and sleeve 12 are formed of thermoplastic materials and are "welded" together using a hot press process.

At the elevation from which the pore fluid is to be extracted, liner 10 defines one or more perforations 14 to allow access of the pore fluids into the interior of sleeve 12. If sleeve 12 is on the exterior of liner 10, sleeve 12 will define perforations 14. The interior 16 of liner 10 is filled with a pressurizing fluid, typically water, that urges liner 10 against the hole wall to effect a seal against vertical flow in the hole. The level of fluid 22 in liner 10 is higher than the level of fluid 24 in the formation 18 to assure the dilation of liner 10 against the hole wall. Sleeve 12 initially has only that fluid that has seeped into sleeve 12 from formation 18, but the fluid pressure in the interior of liner 10 tends to collapse sleeve 12 and prevent any such fluid accumulation in sleeve 12.

Figure 2:
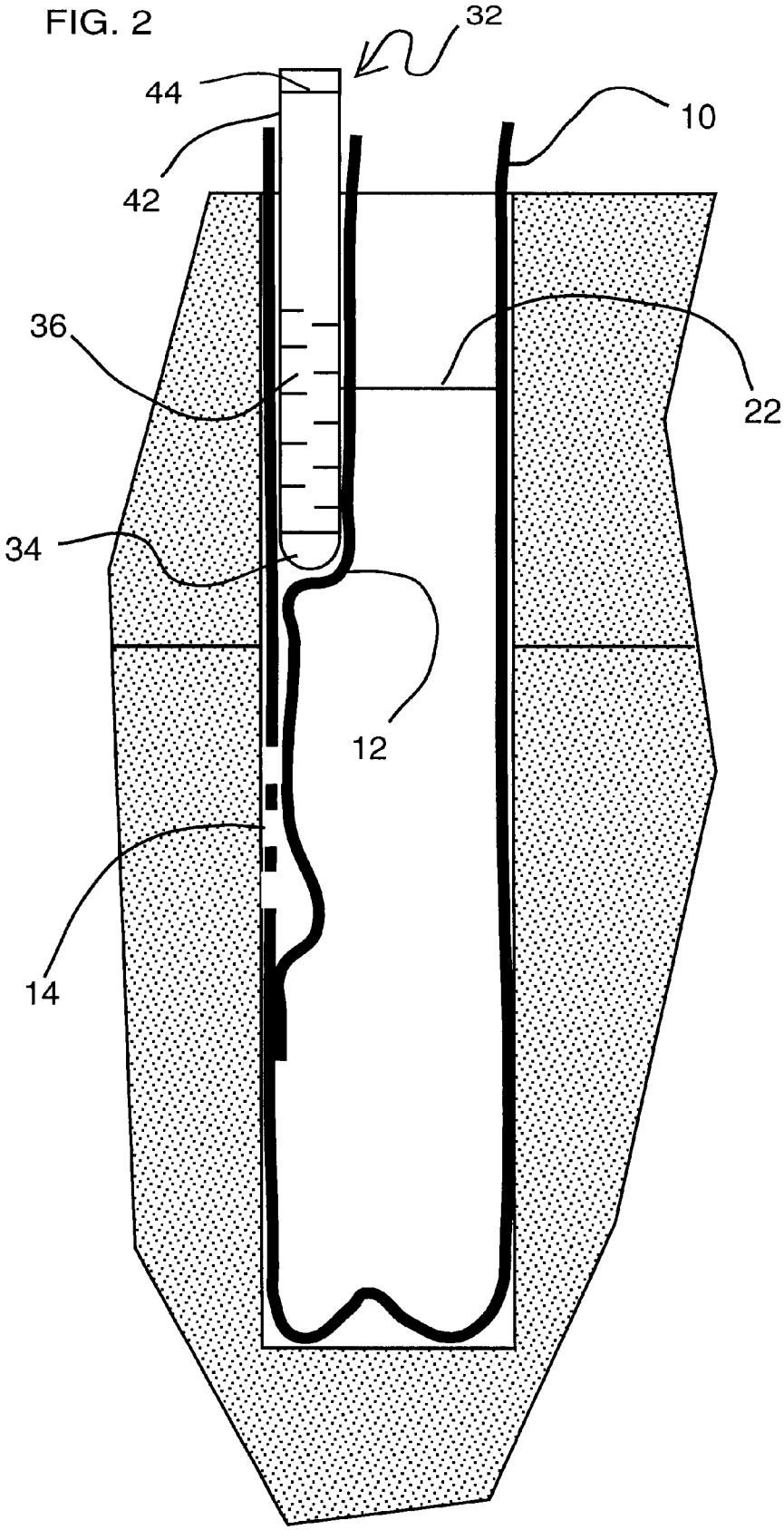
FIG. 2 is a side cross-section showing sampler well emplacement in a well formed in accordance with the present invention.

FIG. 2 depicts emplacement of a slender well casing and screen assembly 32 in sleeve 12. The rounded end 34 of screen 36 is inserted into sleeve 12 and pushed downward until the fluid pressure against the exterior of sleeve 12 resists further insertion. A liquid (e.g., water) is then added to the interior of well casing 42 at the top. The water flows downward in casing 42 and out of screen section 36 to dilate sleeve 12 against the fluid pressure in liner 10. Since the water is added to well casing 42 at a higher level 44, the fluid pressure inside sleeve 12 is greater than that in liner 10. This excess pressure dilates sleeve 12 and allows well casing 42 to be inserted deeper into sleeve 12.

Figure 3:
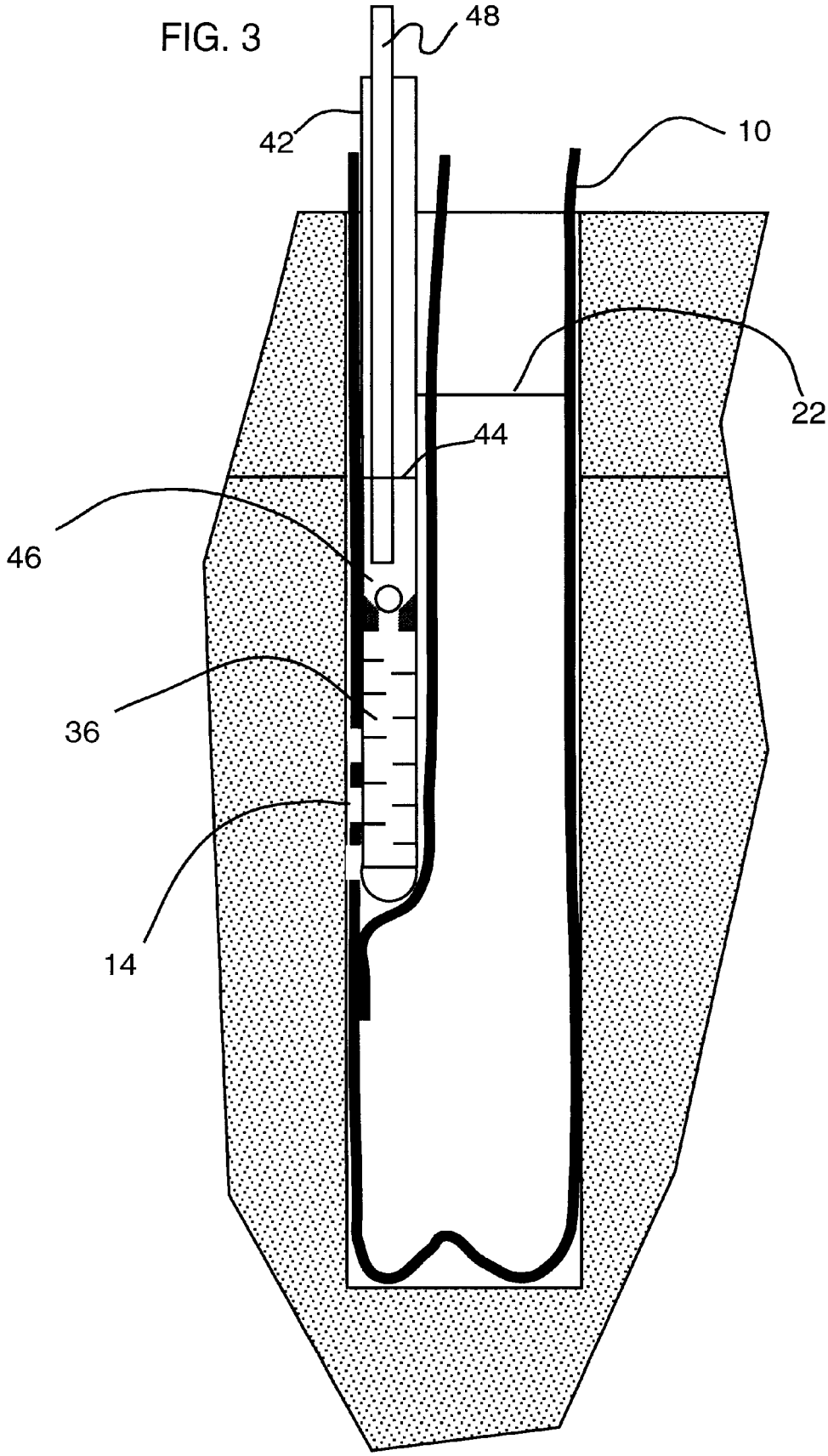
FIG. 3 is a side cross-section showing a sampler well fully emplaced in the liner well.

When well casing 42 reaches the depth desired to align screen 36 with the perforations 14 in liner 10, as shown in FIG. 3, the installation of well casing 42 is complete. Now the water can flow from the formation through perforations 14 in liner 10 into slotted screen 36 at the bottom end of well casing 42. The water 44 rises in well casing 42 to allow withdrawal of the water using a variety of pumping methods. A bailer, a pump tube 48 from a pump at the surface, or a check valve 46 can be included in well casing 42 above screen 36 to allow the water to be forced up a central tube 48 by displacement with a gas pressure provided in well casing 42.

Figure 4A:
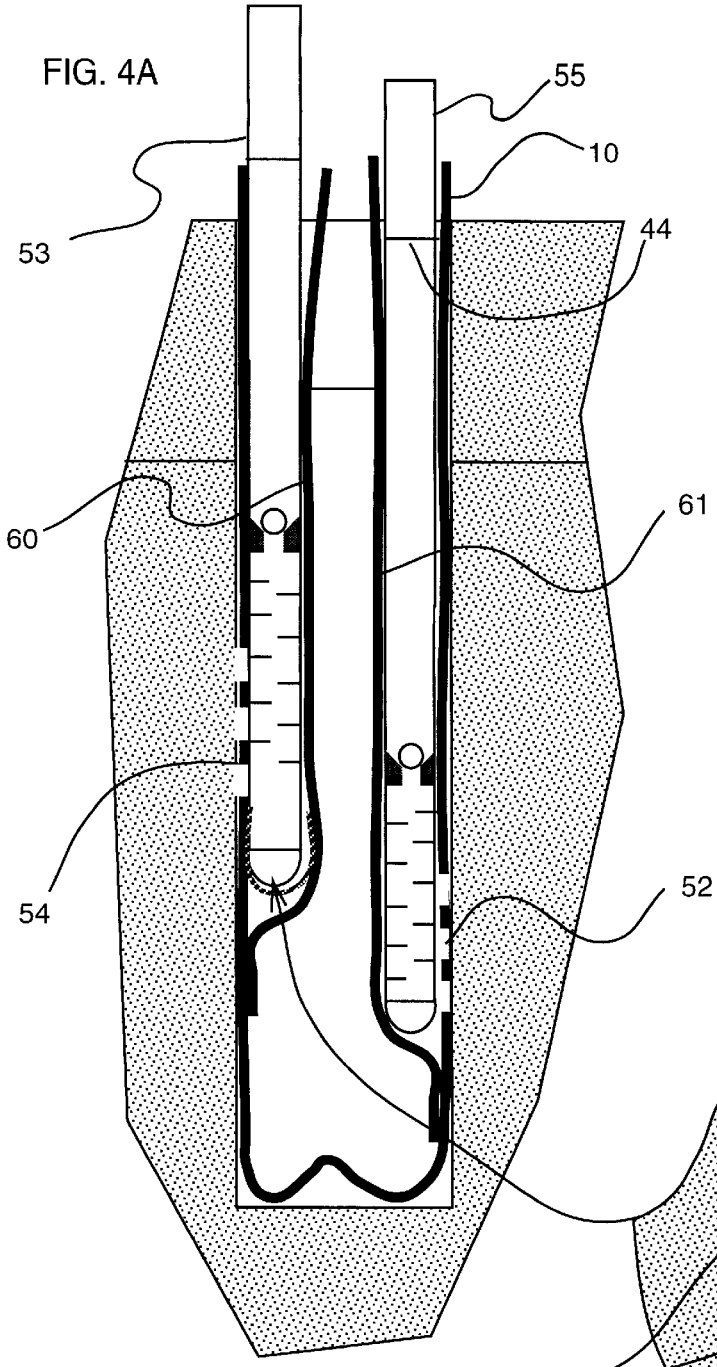
FIGS. 4A and 4B are side cross-sections showing an embodiment having several wells in a single liner for multiple sampling/instrumentation placements.
Figure 4B:
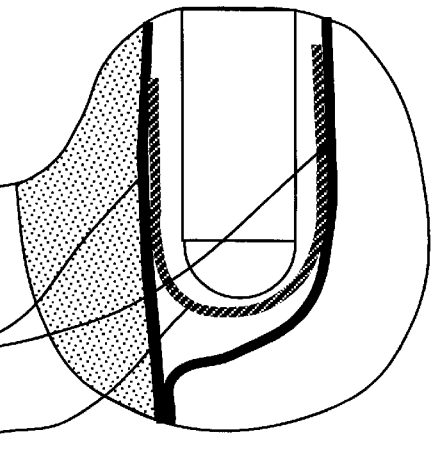

FIGS. 4A and 4B illustrate an embodiment with liner 10 having several interior sleeves 60, 61 to allow pore water sampling at several elevations in a single liner. Another feature is U shaped "stirrups" 58 that may be formed of strips of flexible material welded at locations 59 into the bottom end of sleeves 60, 61 to prevent well casings 53, 55 from being forced past the proper location in the sleeves. Stirrups 58 also serve as a seat for the well casings so that the casings do not rest against the welded lower end of the sleeves and cause a failure of the end weld of the sleeves. Typically, the two side pieces of the stirrup are welded one to the liner and the other to the opposite side of the sleeve to support the end of the casing.

Figure 5:
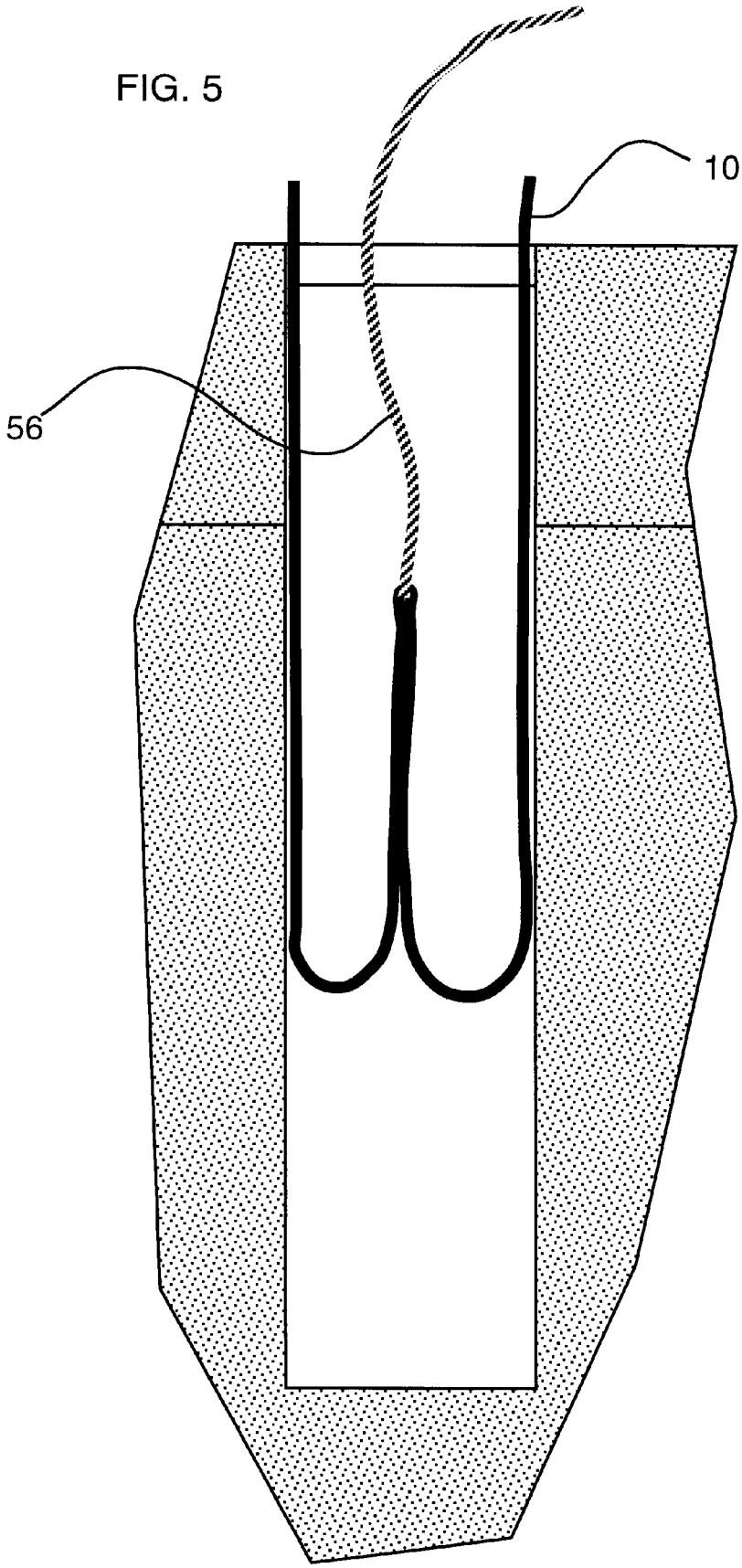

FIG. 5 shows inversion of sleeved liner 10 from the hole after the well casings are withdrawn, if desired. The well casings are removed by simply filling the casing with water to dilate the sleeve against the liner water fill pressure. The casing is withdrawn from the sleeve in the reverse of the installation procedure. Once the casings are removed, liner 10 can be inverted from the hole by pulling upward on central tether 56 provided for that purpose. In some situations, the central tether is a tube that may be used in the emplacement procedure for liner 10.

Figure 6A:
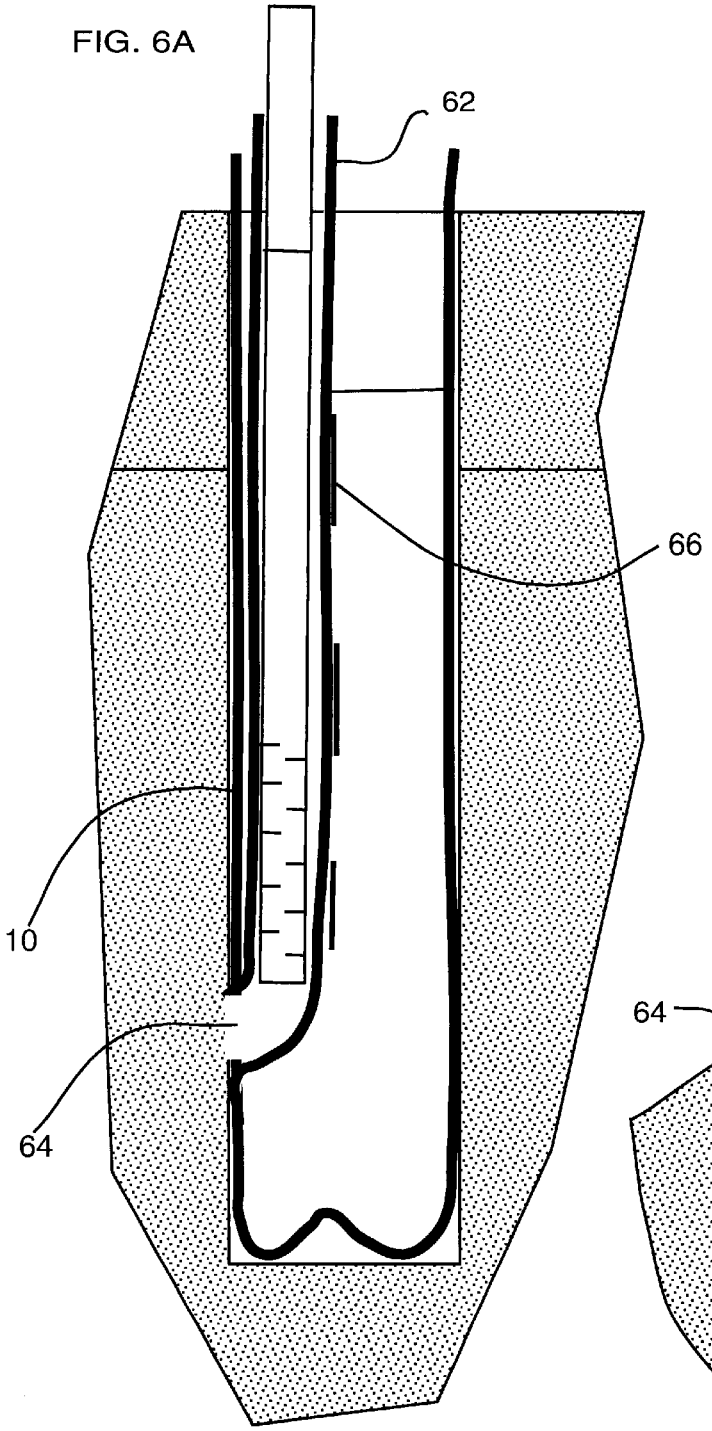
FIGS. 6A and 6B are side and top views of an alternate construction of a well in a flexible liner.
Figure 6B:
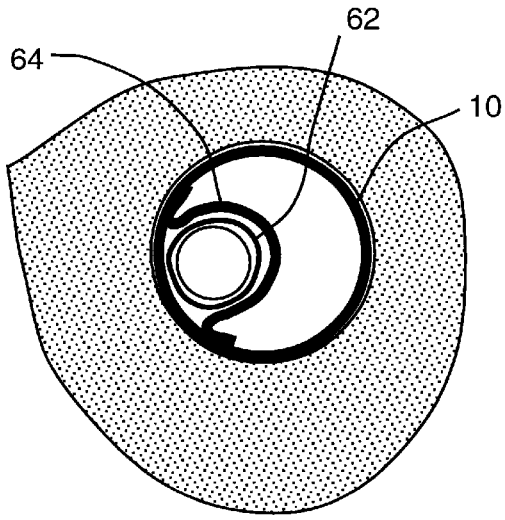

FIGS. 6A and 6B depict an alternate construction of interior sleeve 62. In this embodiment, water tight sleeve 62 is a separate tubular passage connected at its bottom end to orifice 64 through the wall of liner 10. The tubular passage provides a conduit as a sleeve continuously welded to the wall of liner 10, as described for FIGS. 1A and 1B. Sleeve 62 may be made of a very thin walled flexible material. Tubular sleeve 62 may also be attached to the wall of liner 10 at many locations with straps 66, or a discontinuously welded sleeve, to allow liner 10 to be inverted from the hole or everted into the hole.

Figure 7A:
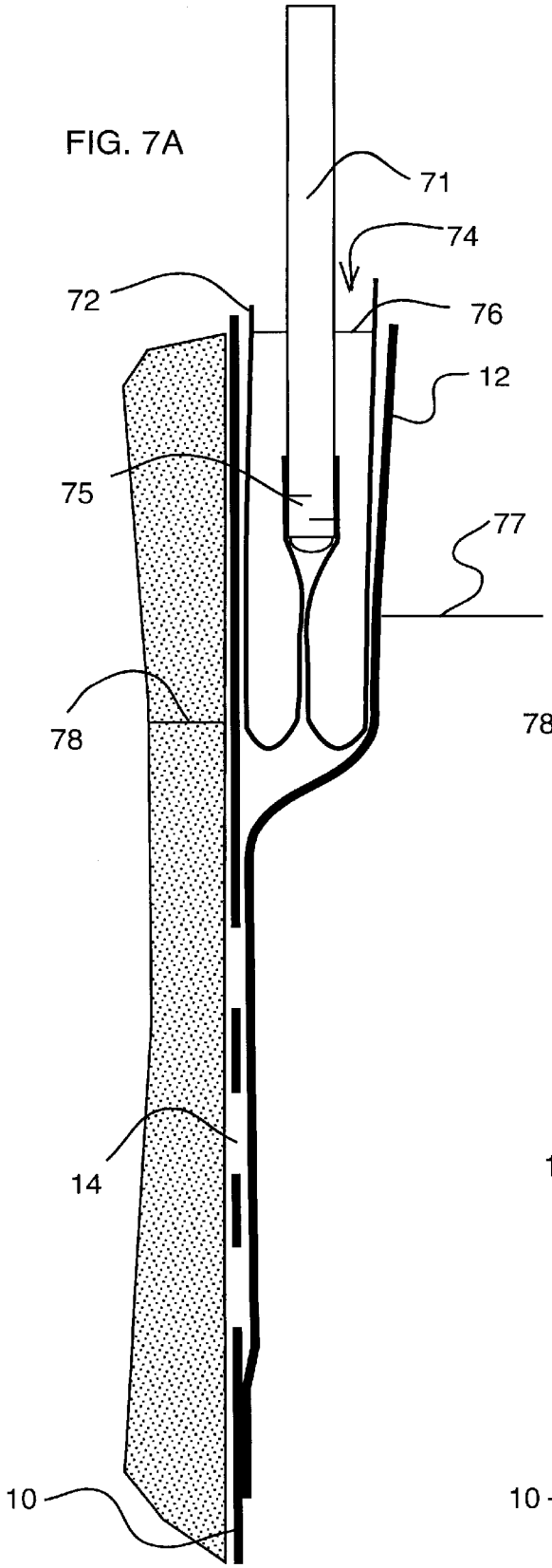
FIGS. 7A and 7B are cross-sections illustrating the use of a small diameter inverting liner to install an instrument/sampling tube in a sleeve.
Figure 7B:
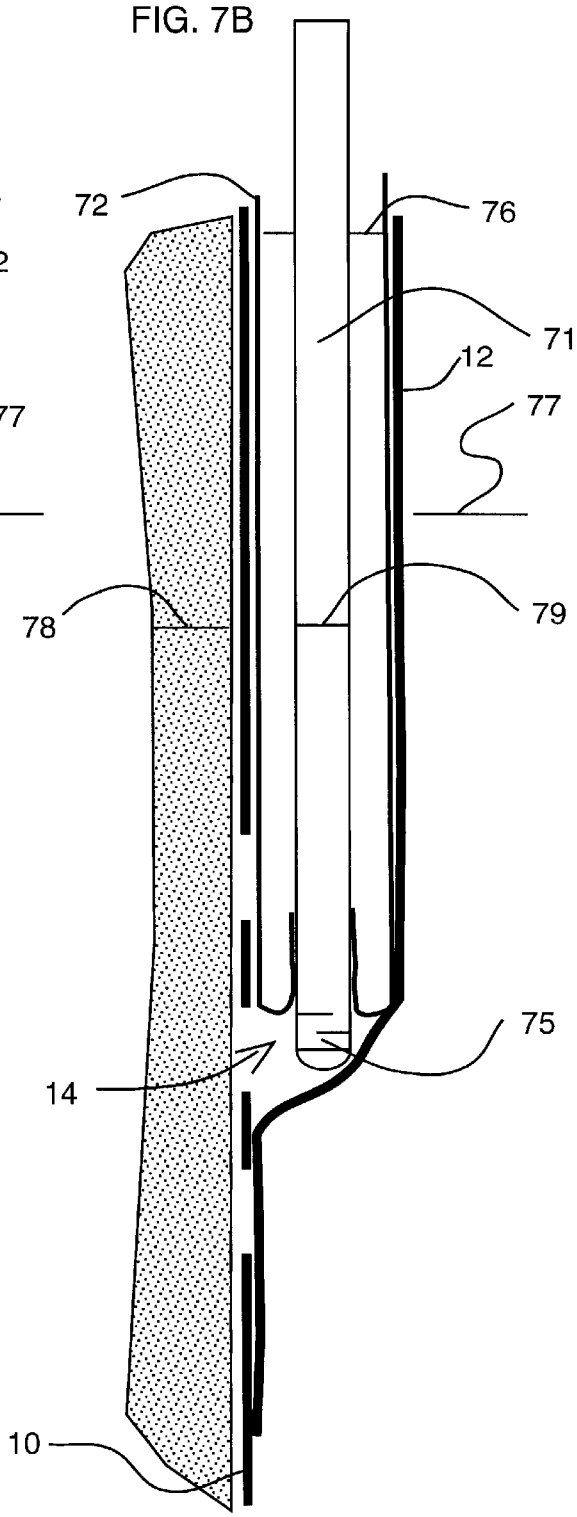

FIGS. 7A and 7B show the installation of a tube 71 in the continuously welded sleeve 12. In some instances, tube 71 lacks the rigidity of the well casings, discussed above, and must be pulled into sleeve 12 via a small diameter everting liner 72. Everting liner 72 is driven by the addition of water at annulus 74. The resulting water level 76 inside everting liner is higher than water level 77 inside sealing liner 10, which is higher than the water table in the formation 78. The result of these three relative levels is that liner 10 is dilated in the hole and sleeve 12 is distended by everting liner 72. Everting liner 72 is attached to tube 71 above the slots in tube end 75.

As everting liner 72 everts, tube 71 is drawn downward through the interior of sleeve 12. Everting liner 72 and tube 71 are sized such that, when everting liner 72 is fully extended, perforated end 75 of tube 71 extends into sleeve 12 adjacent perforations 14 in sealing liner 10. FIG. 7B shows how the water in the formation is free to flow into tube 71 through perforations 14 and into slots 75. Water level 79 in tube 71 rises to a level equal to water level 78 in the formation. This tube geometry allows water to be pumped from the formation via tube 71. In an unsaturated medium, the same installation procedure allows pore gas to be drawn from the formation via tube 71.

The installation of a flexible tubing in the sleeves with everting liners allows the use of the method in holes that are too crooked to allow a rigid well casing to be installed in the sleeves. The everting liners and tubing are removed very simply by pulling upward on the central tube. The same procedure can be used to install tubing in horizontal sealing liners.

Applications

When a hole is drilled into a stable geologic medium, the hole is often stable and self supporting. A flexible liner can be everted, or lowered, into the hole, as desired. The water fill of the liner will support and seal the hole against vertical flow much like an inflatable bladder. This is a relatively inexpensive device for sealing the hole. By providing the sealing liner with the interior sleeves of this invention, well casings, or tubing, can be emplaced in the sleeves to obtain water samples from several depths in the hole sealed by the liner. The number of sampling elevations is only limited by the number of sleeves that can be emplaced on the interior surface of the liner.

In another application, the flexible liner can be emplaced in an unstable hole temporarily supported by a rigid liner as described in U.S. patent application Ser. No. 09/484,299, filed Jan. 18, 2000. The rigid liner can be removed while the hole is supported by the flexible liner. After the rigid liner is withdrawn from the hole, the well casings can be emplaced in the interior sleeves of the flexible liner left in place. This has been done in holes formed by a rigid push rod. The hole formed is very slender (2–3 inch diameter). A particular advantage was that the interior dimension of the rigid liner was too small for any tubing of use in sampling. After the flexible liner dilates in the hole, there is sufficient room for the emplacement of the well casings.

In another application, the flexible liner can be emplaced in a horizontal hole by the common eversion of a flexible liner into a hole. Once the flexible liner is in place, the well casings can be inserted in the interior sleeves to gain the ability to withdraw from, or inject fluids into, the formation.

An advantage of the installation of a flexible liner into a hole, especially a slender hole, is that the liner seals the hole much like a packer (a common inflatable bladder used to seal holes). The quality of the seal of an inflatable liner in the hole is more predictable and of better quality than the common method of filling the annulus between the hole wall and the well casing with a granular or liquid fill material. This is especially true for the sealing of a bundle of well casings in a hole with the associated difficulty of sealing the interstitial spaces of the casing bundle with the fill material. By having all the well casings interior to the sealing liner, the interstitial spaces need not be filled except by the pressurizing fluid in the liner. The fluid is in place before the casings are installed in this method.

Another inherent advantage of this method is that a flexible liner can be inverted into a slender passage without the tubing attached to the liner as is the case in U.S. Pat. No. 5,176,207, to Keller. Once the liner is in position, the tubing can installed separately via the sleeves without the need to evert the tubing with the liner. This allows the use of much more stiff and larger tubing than can be inverted with the liner to withdraw or inject fluids.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A flexible liner system for instrumentation and sampling within a cavity, comprising:

an elongated flexible liner effective for contacting wall portions of the cavity when inflated within the cavity, having a top and a bottom and having perforations open to the cavity wall portions at selected locations along the liner; and at least one sleeve sealed to the flexible liner and extending from the top portion of the liner to a perforation at one of the selected locations along the liner to define a sealed interior open to a cavity wall portion.

2. A flexible liner system according to claim 1, further including a well casing insertable in the interior of the sleeve for emplacing instrumentation or sampling the cavity at the corresponding selected location.

3. A flexible liner system according to claim 1 further including a stirrup at the bottom portion of the sleeve effective to define a bottom of the sleeve.

4. A flexible liner system according to claim 2 further including a stirrup at the bottom portion of the sleeve effective to define a bottom location for the well casing.

5. A flexible liner system according to claim 2, where the well casing includes a well screen for sampling fluids adjacent the perforation in the flexible liner.

6. A flexible liner system according to claim 2, furthering including an everting liner attached to the well casing for moving the well casing through the sleeve.

7. A method for installing instrumentation and sampling devices in a cavity, comprising the steps of:

furnishing a flexible liner having a top portion and a bottom portion and having perforations at selected locations along the liner, and having sleeve members sealed to the flexible liner at each of the perforations to define a sealed interior extending from the adjacent perforation to the top portion of the liner;

placing the flexible liner within the cavity and pressurizing the flexible liner into contact with wall portions of the cavity;

pressurizing the sealed interior of selected sleeve members to equilibrate with pressure in the flexible liner; and inserting a well casing within each pressurized sleeve member to emplace instrumentation or a sampling device adjacent a corresponding perforation; and depressurizing the selected sleeve members to capture the well casing therewithin.

8. A method according to claim 7, further including the step of removing fluids from cavity locations adjacent selected perforations through the corresponding well casing.

9. A method according to claim 7, further including the step of removing the well casings by repressurizing the sleeve member about the well casing to equilibrate pressure with the flexible liner so that the well casing can be readily withdrawn from the sleeve.

10. A method according to claim 7, wherein the step of inserting a well casing in the sleeve further comprises the steps of:

attaching an inverting liner about the well casing; and everting the liner within the sleeve to move the well casing within the sleeve.

* * * * *